US005522746A

United States Patent [19]

Shishido et al.

[11] Patent Number: 5,522,746

[45] Date of Patent: Jun. 4, 1996

[54] MULTI-CYLINDER ENGINE STRUCTURE AND OUTBOARD ENGINE

[75] Inventors: Motoyoshi Shishido; Sadafumi Shidara; Koji Koishikawa; Hiroshi Yamamoto, all of Saitama-ken, Japan

[73] Assignee: Honda Giken Kogyo Kabushiki Kaisha, Tokyo, Japan

[21] Appl. No.: 234,367

[22] Filed: Apr. 28, 1994

Related U.S. Application Data

[62] Division of Ser. No. 896,901, Jun. 11, 1992, Pat. No. 5,326,293, which is a continuation of Ser. No. 672,291, Mar. 20, 1991, abandoned.

[30] Foreign Application Priority Data

Mar. 22, 1990 [JP] Japan ..... 2-29237 U
Mar. 22, 1990 [JP] Japan ..... 2-29238 U

[51] Int. Cl.[6] ..... F02B 13/00

[52] U.S. Cl. ..... 440/76; 123/579; 123/580

[58] Field of Search ..... 440/76, 77, 84, 440/87, 88, 113, 900; 123/59 PC, 195 P, 195 L, 434, 572, 573, 579–584, 59.5, 59.7

[56] References Cited

U.S. PATENT DOCUMENTS

| | | | |
|---|---|---|---|
| 1,462,782 | 7/1923 | Barbarou | 123/580 |
| 1,791,490 | 2/1931 | Dilworth | 123/580 |
| 1,875,444 | 4/1932 | Hall | 123/580 |
| 2,556,463 | 6/1951 | Bicknell | 123/580 |
| 4,445,466 | 5/1984 | Zaita | 123/580 |
| 4,463,711 | 8/1984 | Yoshioka | 123/580 |
| 4,881,510 | 11/1989 | Etoh | 123/572 |
| 4,947,807 | 8/1990 | Flaig | 123/579 |
| 5,018,503 | 5/1991 | Hoshiba | 123/580 |
| 5,036,805 | 8/1991 | Yamamoto | 123/574 |

FOREIGN PATENT DOCUMENTS 4-1661 1/1992 Japan .

*Primary Examiner*—Robert J. Oberleitner
*Assistant Examiner*—C. T. Bartz
*Attorney, Agent, or Firm*—Armstrong, Westerman, Hattori, McLeland & Naughton

[57] ABSTRACT

A multi-cylinder engine structure includes a multi-cylinder engine body having a plurality of cylinders vertically arranged therein. A fuel feed system has a fuel pump connected to a plurality of carburetors disposed in a vertical arrangement sideways of the engine body in independent correspondence to the cylinders. The fuel pump is disposed below a lowermost one of the plurality of carburetors arranged vertically. An outboard engine includes a case tiltably mounted at a stern. A multi-cylinder engine body is contained in the case. A fuel feed system supplies a fuel to a plurality of carburetors disposed in correspondence with the cylinders. A fuel filter is also provided. The fuel pump is disposed below a lowermost one of the plurality of carburetors arranged vertically and above the fuel filter in a tilted-down state of the case.

12 Claims, 4 Drawing Sheets

MULTI-CYLINDER ENGINE STRUCTURE AND OUTBOARD ENGINE

This is a division of application Ser. No. 07/896,901, filed Jun. 11, 1992, now U.S. Pat. No. 5,326,343 issued Jul. 5, 1994; which is a continuation of application Ser. No. 07/672,291, filed on Mar. 20, 1991, now abandoned.

BACKGROUND OF THE INVENTION

1. Field of the Invention

The present invention generally relates to a) multi-cylinder engine structure including a multi-cylinder engine body having a plurality of cylinders vertically arranged therein, and a fuel feed system having a fuel pump connected to a plurality of carburetors disposed in a vertical arrangement sideways of the engine body in independent correspondence to the cylinders, and b) an outboard engine constructed with the multi-cylinder engine structure contained within a case attached to a stern.

2. Description of the Related Art

A multi-cylinder engine structure and an outboard engine are known and described in, for example, Japanese Patent Application Laid-Open Publication No. 26367/87.

A fuel vapor may be produced within a line, such as, a hose for conducting fuel from the fuel pump to the plurality of carburetors, and if a vapor lock occurs due to the fuel vapor, the fuel is not smoothly supplied to the carburetors.

As described in Japanese Utility Model Application Laid-Open Publication No. 142563/89, a multi-carburetor which maybe used in some cases, has a plurality of carburetors operatively connected to one another through a link mechanism, and in such a case, if a cover, as a component for the case covering the engine body, collides against the link mechanism for the multi-carburetor during attachment or removal of the cover, or if an external force is applied to the cover inwardly and effected on the link mechanism, the link mechanism may be deformed; thereby, interfering with a synchronous operation of the multi-carburetor.

SUMMARY OF THE INVENTION

Accordingly, it is an object of the present invention to provide a multi-cylinder engine structure and an outboard engine, wherein the supply of fuel to the individual carburetors can be smoothly effected.

In order to achieve the above object, according to the present invention, a multi-cylinder engine structure is provided having a multi-cylinder engine body with a plurality of cylinders vertically arranged therein. A fuel feed system has a fuel pump connected to a plurality of carburetors disposed in a vertical arrangement sideways of the engine body in independent correspondence to the cylinders, wherein the fuel pump is disposed below a lowermost one of the plurality of carburetors arranged in the vertical arrangement.

In addition, according to the present invention, an outboard engine is provided having a case tiltably mounted at a stern. A multi-cylinder engine body is contained in the case and has a plurality of cylinders arranged vertically in a tilted-down state of the case. A plurality of carburetors are disposed sideways of the engine body within the case in correspondence to the individual cylinders. A fuel pump is connected to the carburetors and is disposed within the case. A fuel filter is connected to an inlet of the fuel pump and is disposed within the case. A fuel feed system has a connector mounted on the case to connect a fuel tank disposed outside the case to the filter, wherein the fuel pump is disposed below a lowermost one of the plurality of carburetors arranged vertically and above the fuel filter in a tilted-down state of the case.

Further, according to another aspect of the present invention, in the multi-cylinder engine structure, a stationary member disposed around a periphery of the multi-carburetor is provided with a protrusion which projects toward the case more than the multi-carburetor.

In the outboard engine, protector devices are fixedly mounted in the front and rear portions of the link mechanism and located closer to an inner surface than to the link mechanism in the tilted-down state of the case.

The above and other objects, features and advantages of this invention will become apparent from a reading of the following description of the preferred embodiments, taken in conjunction with the accompanying drawings.

BRIEF DESCRIPTION OF THE DRAWINGS

The drawings illustrate one embodiment of the present invention, wherein.

DESCRIPTION OF THE PREFERRED EMBODIMENT

Figure 1:
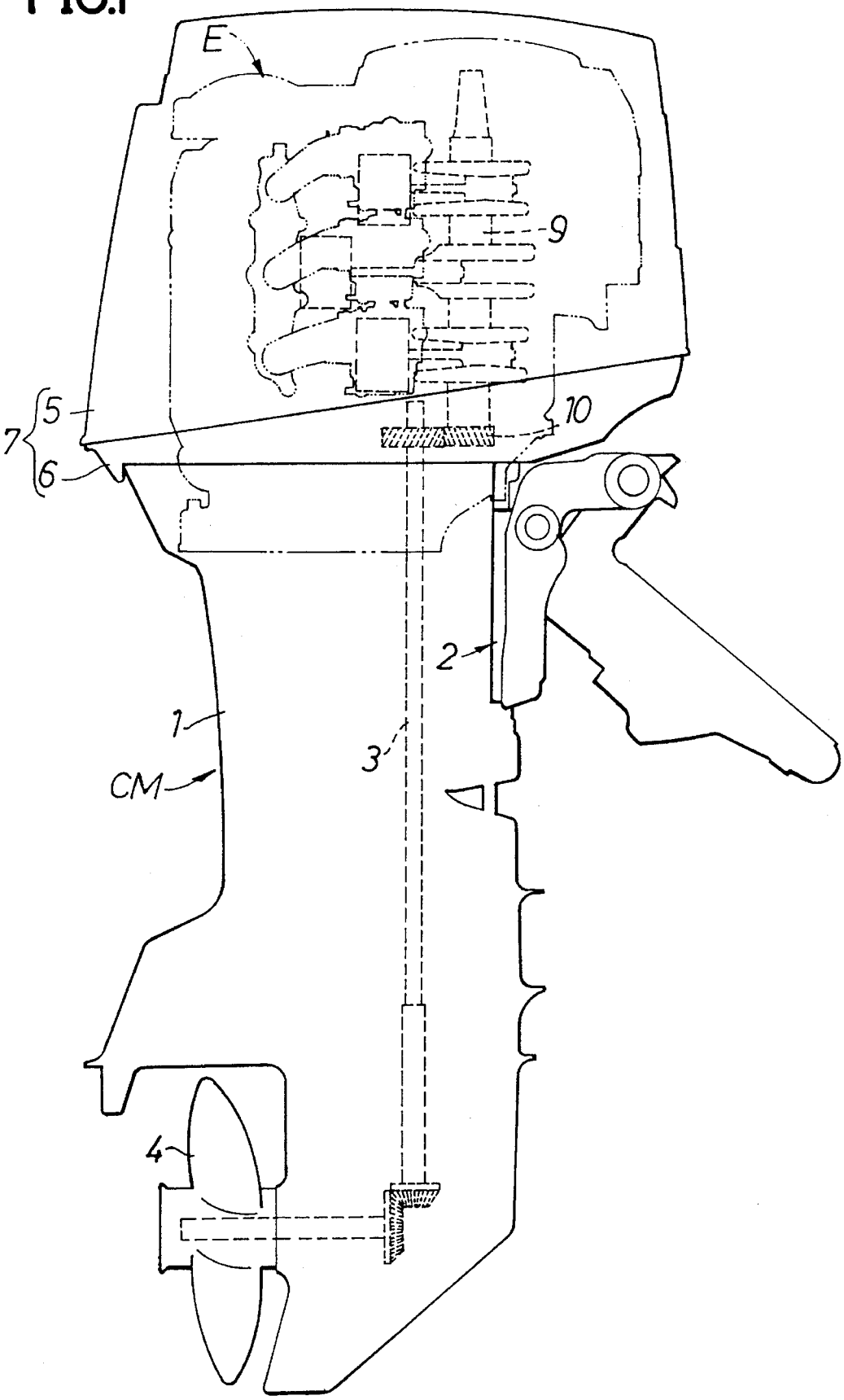
FIG. 1 is a side view of an outboard engine.

Referring first to FIG. 1, a casing 1 of an outboard engine structure is tiltably mounted on a stern plate of a hull (not shown) through a supporting means 2. A power from an engine E mounted on an upper portion of the casing 1 is transmitted through a driving force transmitting means 3 contained in the casing 1 to a propeller 4 carried on a lower portion of the casing 1. A case CM is formed by the casing 1 and a cover 7 connected to the upper end of the casing 1. The cover 7 includes a lower cover member 6 fixedly connected to the casing 1, and an upper cover member 5 detachably connected to the lower cover member 6. The engine E mounted on the casing 1 is contained in an engine room R defined in the cover 7.

Figure 2:
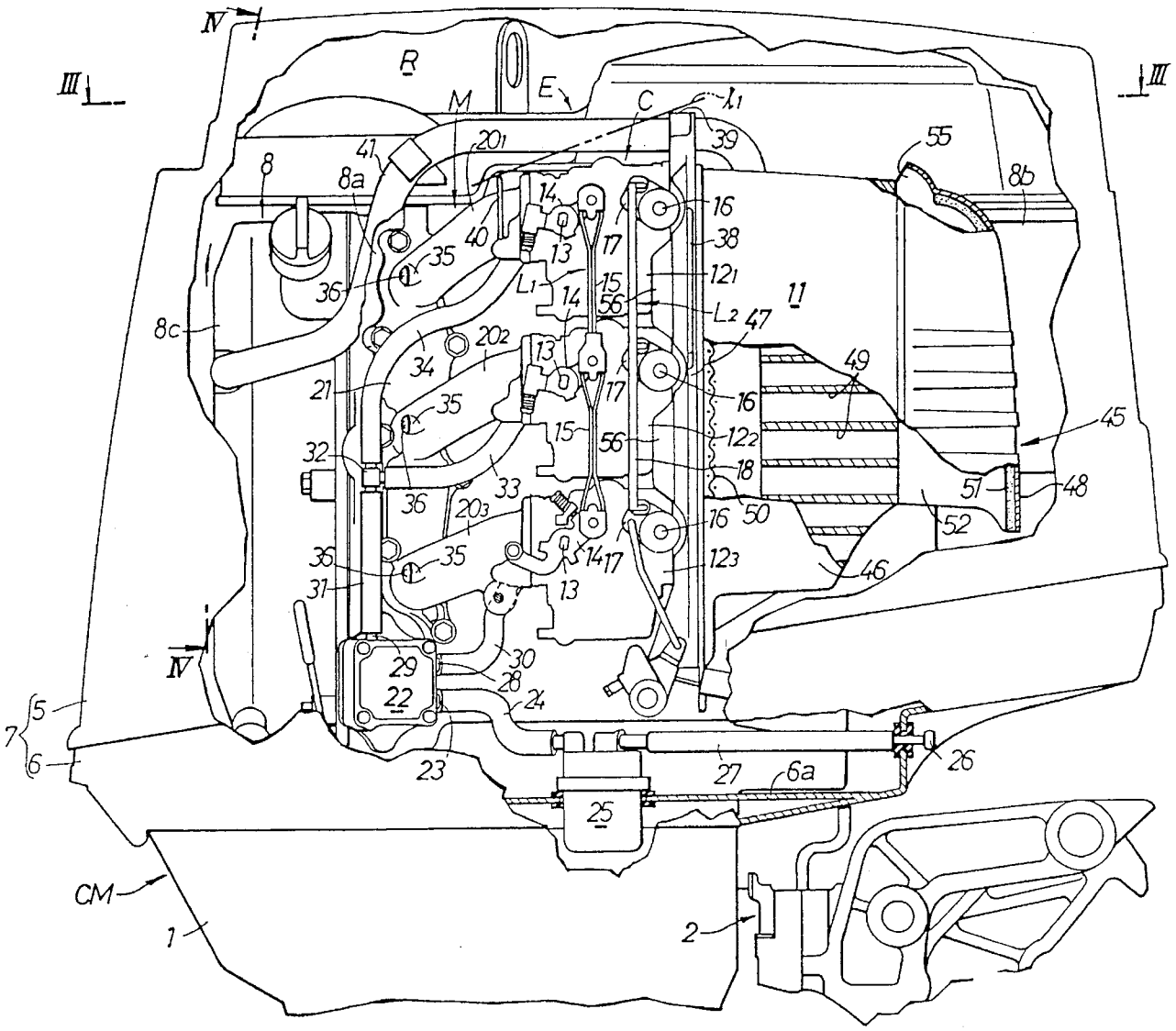
FIG. 2 is an enlarged vertical sectional side view of an essential portion shown in FIG. 1.

As illustrated in FIG. 2, the engine E is a vertical three-cylinder and four-cycle engine including a three-cylinder engine body 8 with cylinders vertically arranged in a tilted-down state of the case CM. The engine body 8 is mounted on the upper end of the casing 1 in a posture with its cylinder head 8*a* disposed on rear side (on the left side as viewed in FIG. 2) and its crankcase 8*b* disposed on the front side (on a right side as viewed in FIG. 2) in a tilted-down state. As shown in FIG. 1, a vertical crankshaft 9 is connected to the driving-force transmitting means 3 through a gear mechanism 10.

An intake gas silencer box 11 is fixedly disposed sideways of the crankcase 8*b* in the engine body 8, and a multi-carburetor C is connected to the intake gas silencer box 11. More specifically, the multi-carburetor C includes three carburetors $\mathbf{12}_1$, $\mathbf{12}_2$ and $\mathbf{12}_3$ which independently correspond to the cylinders of the engine body 8 and are operatively connected to one another so that they are vertically arranged in the tilted-down state of the case CM. The carburetors $12_1$, $12_2$ and $12_3$ are commonly connected to the intake gas silencer 11. In the multi-carburetor C, the carburetors $12_1$, $12_2$ and $12_3$ have throttle valve stems 13 operatively interconnected through a first link mechanism $L_1$ which includes throttle levers 14 each connected to a corresponding one of the throttle valve stems 13, and connecting members 15 for connecting the adjacent throttle levers 14. The carburetors $12_1$, $12_2$ and $12_3$ also have choke valve stems 16 operatively interconnected through a second link mechanism $L_2$ which includes choke levers 17 each connected to corresponding one of the choke valve stems 16, and a link 18 for commonly connecting the choke levers 17. Thus, the throttle lever 14 and the choke lever 17, of a lowermost carburetor $12_3$ of the carburetors $12_1$, $12_2$ and $12_3$, are rotatively driven, so that the throttle levers 14 and the choke levers 17 of the remaining carburetors $12_1$ and $12_2$ are also interlockingly driven by the operation of the link mechanisms $L_1$ and $L_2$.

An intake manifold M is connected to the carburetors $12_1$, $12_2$ and $12_3$ in the multi-carburetor C. More specifically, the intake manifold M includes three intake pipes $20_1$, $20_2$ and $20_3$ independently corresponding to the cylinders in the engine body 8 and independently connected at end portions thereof to the carburetors $12_1$, $12_2$ and $12_3$, respectively. A common flange 21 is mounted at the other ends of the intake pipes $20_1$, $20_2$ and $20_3$ in the intake manifold $M_A$ so that the carburetors $12_1$, $12_2$ and $12_3$ can be independently put into communication with combustion chambers (not shown) in the cylinders of the engine body 8 through the corresponding intake pipes $20_1$, $20_2$ and $20_3$, respectively.

The intake silencer box 11 includes a housing 45 which includes a passage member 46 for defining a plurality of intake passages 49 having axes parallel to intake paths of the carburetors $12_1$, $12_2$ and $12_3$ in the multi-carburetor C, and a flange 47 connected to an end portion of the passage member 46, and a guide cover 48 connected to the other end of the passage member 46. The multi-carburetor C is connected to the flange 47. Moreover, a net member 50 is placed on the side of the flange 47 within the passage member 46 for preventing the ingress of dust into the multi-carburetor C and for preventing the ingress of back fire into the passage member 46. An acoustic insulating material 51, such as, foamed urethane, is applied to an inner surface of the guide cover 48 which is provided at its lower portion with an air intake port 52 and at its upper portion with a vent hole 55. The flange 47 is provided with projections 56 which protrude toward the link 18 between the choke valve stems 16 of the multi-carburetor C and permit the gap between the second link mechanism $L_2$ and the intake silencer box 11 to be set smaller.

Such an intake silencer box 11 permits intake noise produced in an intake stroke in the engine body 8 to be damped by way of a pipe length effect of each of the intake passages 49 and absorbed by the acoustic insulating material 51; thereby, providing a high silencing effect.

In the tilted-down state of the case CM, a fuel pump 22 driven by a cam shaft (not shown) is fixedly supported on the cylinder head **8*a*** below and rearwardly of the multi-carburetor means C; i.e., below the lowermost carburetor $12_3$ of the carburetors $12_1$, $12_2$ and $12_3$.

An inlet pipe 23 is mounted on the outer surface of the fuel pump 22 which faces toward the crankcase **8*b*, and a fuel filter 25 located forwardly (i.e., on the right side, as viewed in FIG. 2) of and below the fuel pump 22 in the tilted-down state of the case CM, is connected to the intake pipe 23 through a hose 24. A connecting pipe 26 projecting outwardly is fixedly supported on the lower cover member 6 of the cover 7, and connected to the fuel filter 25 through a hose 27. The fuel filter 25 is fixedly supported with its lower portion fitted into a bottom portion 6*a* of the lower cover member 6**.

A fuel tank (not shown) located outside the case CM is connected to the connecting pipe 26 so that the operation of the fuel pump 22 causes fuel pumped from the fuel tank to be introduced through the connecting pipe 26 and via the hose 27 into the fuel filter 25, and the fuel cleaned in the fuel filter 25 is drawn through the hose 24 and via the intake pipe 23 into the fuel pump 22.

The fuel pump 22 also includes a discharge pipe 28 mounted at its outer side directed to the crankcase **8*b* above the intake pipe 23, and a discharge pipe 29 mounted at its outer side directed upwardly. The discharge pipe 28 is connected to the carburetor $12_3$, while the other discharge pipe 29** is connected to the carburetors $12_1$ and $12_2$.

More specifically, the discharge pipe 28 is connected to the lowermost carburetor $12_3$ through a hose 30 extending forwardly from the fuel pump 22. A hose 31 extending vertically is connected to the other discharge pipe 29 at its lower end, and an upper end portion of the hose 31 is connected to a three-way connecting member 32 which is disposed to substantially correspond with an intermediate location between the central carburetor $12_2$ and the lowermost carburetor $12_3$ of the vertically disposed. The connecting member 32 and the carburetor $12_2$ are connected to each other through a hose 33, and the connecting member 32 and the uppermost carburetor $12_1$ are connected to each other through a hose 34. With such a connecting structure, all the directions of flow of the fuel from the fuel pump 22 toward the carburetors $12_1$, $12_2$ and $12_3$ are in the upward direction.

It is noted that it is necessary to confirm the intake pressure within each of the intake pipes $20_1$, $20_2$ and $20_3$ in the intake manifold M when the carburetors $12_1$, $12_2$ and $12_3$ of the multi-carburetor means C are synchronously adjusted. To this end, a boss 35, to which an adapter for detecting the intake pressure is connected, is provided at an intermediate portion of each of the intake pipes $20_1$, $20_2$ and $20_3$ in the intake manifold M, and a threaded plug 36 is detachably and threadedly engaged with the boss 35. In order to facilitate the connection of each of the adapters and the detachment of the threaded plug 36 and to prevent the liquid fuel flowing along the bottom surface of the intake pipes $20_1$, $20_2$ and $20_3$ from entering the adapters, the bosses 35 are mounted on a sidewall opposite from the engine body 8 at vertically intermediate locations in longitudinally middle portions of the intake pipes $20_1$, $20_2$ and $20_3$, respectively.

Figure 3:
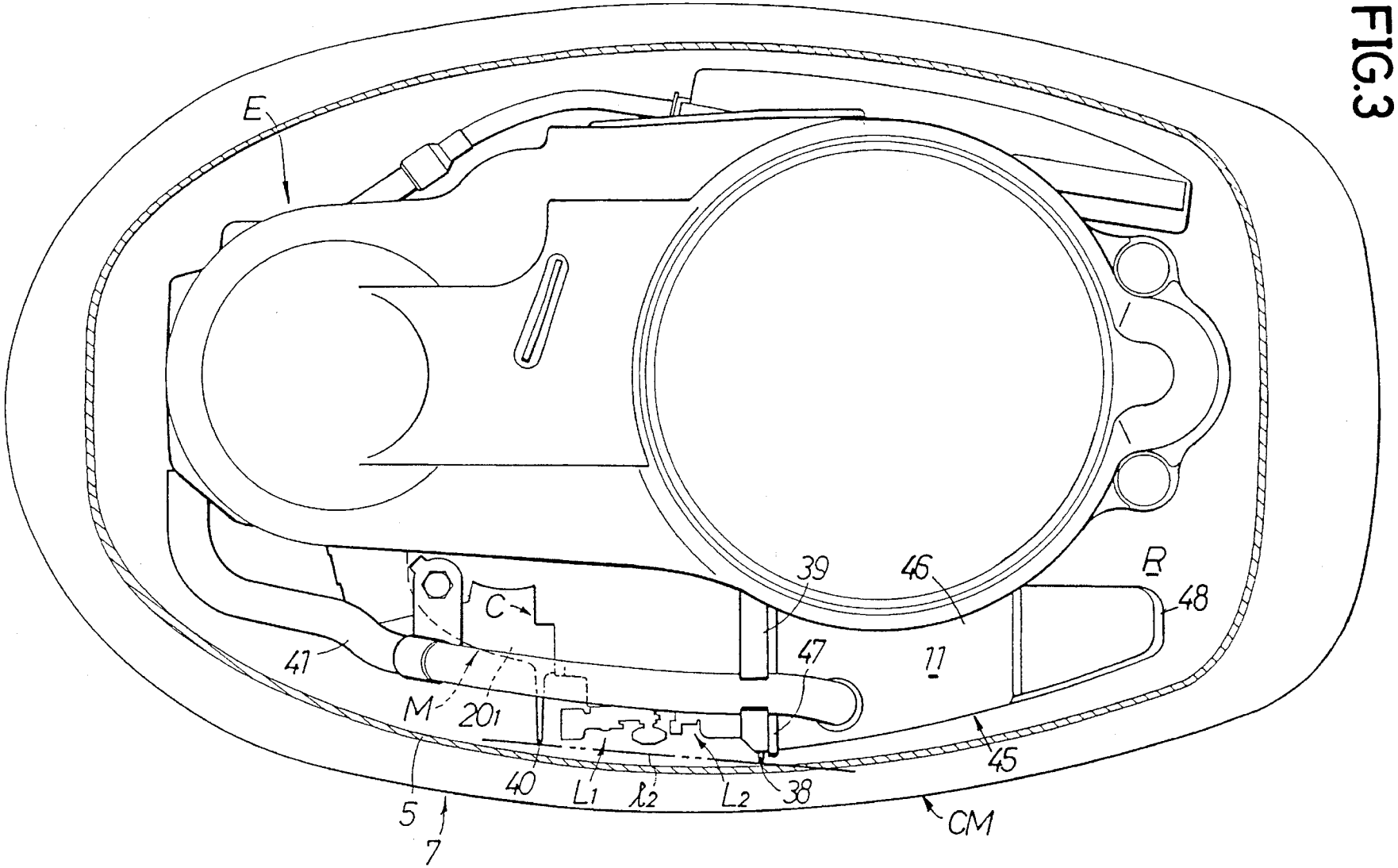
FIG. 3 is a sectional view taken along a line III—III in FIG. 2.
Figure 4:
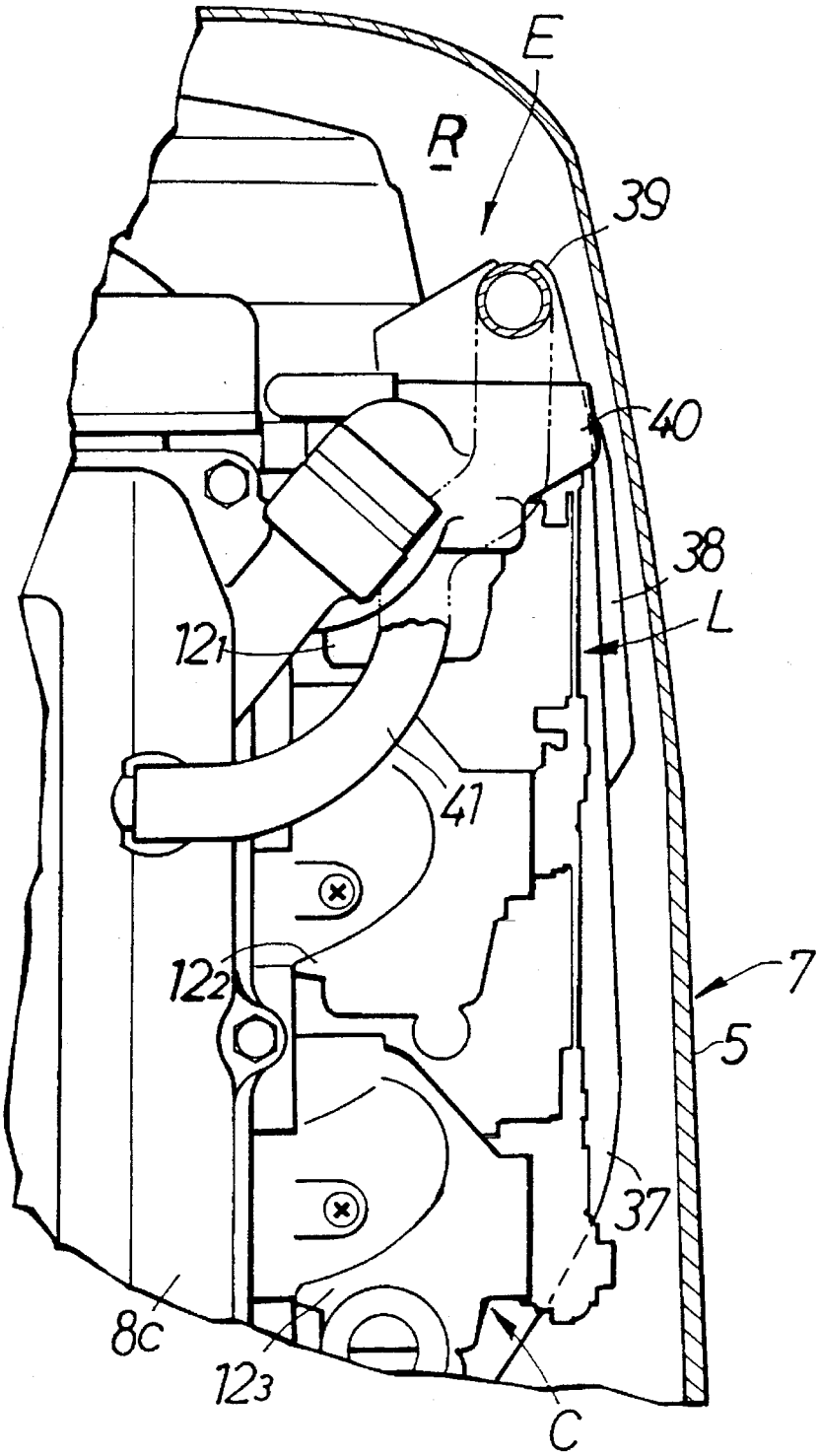
FIG. 4 is a sectional view taken along a line IV—IV in FIG. 2.

Referring to FIGS. 3 and 4, in order to avoid any malfunction of the first and second link mechanisms $L_1$ and $L_2$ for interlockingly operating the carburetors $12_1$, $12_2$ and $12_3$ of the multi-carburetor C due to contact of the cover 7 with the first and second link mechanisms $L_1$ and $L_2$ in the vertical type three-cylinder engine E, a stationary member located around the periphery of the multi-carburetor C within the engine room R; e.g., the flange 47 mounted on the intake silencer box 11 forwardly of the multi-carburetors means C, is provided, at a location corresponding to the carburetors $12_1$ and $12_2$, with a protrusion 38 serving as a protector and projecting sideways toward the cover 7, and is also provided with a protrusion 39 serving as a protector and projecting toward the cover 7 upwardly above the uppermost carburetor $12_1$. In addition, another stationary member located rearwardly of the multi-carburetor C; e.g., the intake pipe $20_1$ in the intake manifold M is provided with a protrusion 40 serving as a protector and projecting toward the cover 7 upwardly and sideways above the first and second link mechanisms $L_1$ and $L_2$.

A phantom line $l_1$ connecting leading ends of the protrusions 39 and 40 lies between the upper portion of the upper cover member 5 of the cover 7 and the first and second link mechanisms $L_1$ and $L_2$, and a phantom line $l_2$ connecting leading ends of the protrusions 38 and 40 lies between the side portion of the upper cover member 5 of the cover 7 and the first and second link mechanisms $L_1$ and $L_2$.

Moreover, the leading end of the protrusion 40 also functions to support an intermediate portion of a breather pipe 41 for conducting breather gas from the head cover 8*c* of the engine body 8 to the intake silencer box 11.

The operation of this embodiment is described below. The fuel pump 22 has the pair of discharge pipes 28 and 29 for the carburetors $\mathbf{12}_1$, $\mathbf{12}_2$ and $\mathbf{12}_3$ of the multi-carburetor C. Consequently, the variety of connecting pipings between the fuel pump 22 and the carburetors $\mathbf{12}_1$, $\mathbf{12}_2$ and $\mathbf{12}_3$ is increased, as compared to a fuel pump having only a single discharge pipe. This structural arrangement contributes to an improvement in the balance of the flow rates of the fuel to the carburetors $\mathbf{12}_1$, $\mathbf{12}_2$ and $\mathbf{12}_3$.

The fuel pump 22 located above the fuel filter 25 is disposed below the lowermost carburetor $\mathbf{12}_3$ of the multi-carburetor C so that all the directions of flow of the fuel from the fuel filter 25 via the fuel pump 22 to the carburetors $\mathbf{12}_1$, $\mathbf{12}_2$ and $\mathbf{12}_3$ can be upward. Therefore, even if a vapor of the fuel is produced within the hoses 24, 30, 31, 33 and 34 for conducting the fuel from the fuel filter 25 via the fuel pump 22 to the carburetors $\mathbf{12}_1$, $\mathbf{12}_2$ and the vapor of the fuel is smoothly led to the carburetors $\mathbf{12}_1$, $\mathbf{12}_2$ and $\mathbf{12}_3$ and hence, the vapor lock phenomenon can be reliably prevented from being produced in the hoses 24, 30, 31, 33 and 34; thereby, realizing a smooth supply of the fuel.

Further, the fuel filter 25 is supported on the bottom portion 6*a* of the lower cover portion 6; and hence, when the upper cover member 5 is removed for maintenance of the engine E, the maintenance of the fuel filter 25 can also be simultaneously conducted.

Moreover, the protrusions 38 and 39 provided on the flange 47 located at a fixed position around the periphery of the first and second link mechanisms $L_1$ and $L_2$ of the multi-carburetor C, and the protrusion 40 provided on the intake pipe $\mathbf{20}_1$ are disposed so that the phantom line $l_1$ connecting the leading ends of the protrusions 39 and 40 lies between the upper portion of the upper cover member 5 and the first and second link mechanisms $L_1$ and $L_2$; and the phantom line $l_2$ connecting the leading ends of the protrusions 38 and 40 lies between the side portion of the upper cover member 5 and the first and second link mechanisms $L_1$ and $L_2$. This structural arrangement ensures that the contact of the cover 7 with the first and second link mechanisms $L_1$ and $L_2$ can be avoided to the utmost, even if an external force is applied to the cover 7 to inwardly deflect the latter, and the first and second link mechanisms $L_1$ and $L_2$ can be prevented from being deformed due to the contact thereof with the cover 7.

Although the example applied to the three-cylinder vertical engine has been described in the above embodiment, it will be understood that the present invention is not limited to the three-cylinder type and is widely applicable to a vertical multi-cylinder engine, as well as an outboard engine structure using the multi-cylinder engine.

The above description is included to illustrate the operation of the preferred embodiments and is not meant to limit the scope of this invention. The scope of this invention is to be limited only by the following claims. From the above discussion, many variations are apparent to one skilled in the art which would yet be encompassed by the spirit and scope of this invention.

What is claimed is:

1. An engine comprising:

an engine body and a crankshaft disposed vertically, the engine body being mounted in an engine room defined in a cover, the engine body having therein a first chamber defined partially by a cylinder head cover and a second chamber defined partially by a crankcase, said first and second chambers being disposed horizontally;

an intake box being disposed on one side of said engine body and a breather pipe being disposed on said one side of the engine body so as to communicate said first chamber and said intake box;

adjusting means for adjusting an output of said engine by adjusting supply of air-fuel mixture into a combustion chamber of the engine; and control means for controlling operation of said adjusting means by link means operatively connected to said adjusting means, said adjusting means and said control means being disposed on said one side of the engine body within said engine room, a space for receiving said breather pipe on said one side of the engine body being extended within said engine room so as not to interrupt an operation of said link means which is performed at said one side of the engine body.

2. An engine according to claim 1, wherein said intake box is connected to said adjusting means and is disposed on a side of said adjusting means opposite to said first chamber, said breather pipe extending substantially horizontally above said adjusting means.

3. An engine according to claim 2, wherein said adjusting means is provided as a plurality of adjusting means disposed vertically, and said control means is provided for interlockingly operating the plurality of adjusting means.

4. An engine according to claim 1 or 2, wherein said breather pipe is carried at an intermediate portion thereof.

5. An engine according to claim 3, wherein said breather pipe is carried at an intermediate portion thereof.

6. An outboard engine comprising:

an engine and an engine cover for covering said engine, said engine including an engine body and a crankshaft disposed vertically, the engine body being mounted in an engine room defined in said engine cover, the engine body having therein a first chamber defined partially by a cylinder head cover and a second chamber defined partially by a crankcase, said first and second chambers being disposed horizontally;

an intake box being disposed on one side of said engine body and a breather pipe being disposed on said one side of the engine body so as to communicate said first chamber and said intake box;

adjusting means for adjusting an output of said engine by adjusting supply of air fuel mixture into a combustion chamber by operating throttle valve stem means; and control means for controlling operation of said adjusting means by link means operatively connected to said throttle valve stem means, said adjusting means and said control means being disposed on said one side of the engine body within said engine room, a space for receiving said breather pipe on said one side of the engine body being extended within said engine room so as not to interrupt an operation of said link means which is performed at said one side of the engine body.

7. An outboard engine according to claim 6, wherein said intake box is connected to said adjusting means and is disposed on a side of said adjusting means opposite to said first chamber, said space being defined between the engine cover and said adjusting means.

8. An outboard engine according to claim 7, wherein said adjusting means is provided as a plurality of adjusting means disposed vertically, and said control means is provided for interlockingly operating the plurality of adjusting means.

9. An outboard engine according to claim 6 or 7, wherein said breather pipe is carried at an intermediate portion thereof.

10. An outboard engine according to claim 7, wherein said adjusting means is provided at one lateral side thereof with said throttle valve stem means, said space being located above the adjusting means.

11. An outboard engine according to claim 8, wherein said adjusting means is provided at one lateral side thereof with a plurality of throttle valve stems which are operable and interlocked together at portions on said one lateral side, said space being located above the adjusting means.

12. An outboard engine according to claim 9, wherein said breather pipe is carried by a part of said intake box.

* * * * *